US011807961B2

(12) United States Patent
Spessato

(10) Patent No.: US 11,807,961 B2
(45) Date of Patent: Nov. 7, 2023

(54) TWISTING FLYER FOR SINGLE-TWIST CABLE STRANDING MACHINE

(71) Applicant: W.T.M. SOCIETA' A RESPONSABILITA' LIMITATA, Padua (IT)

(72) Inventor: Alberto Spessato, Padua (IT)

(73) Assignee: W.T.M. SOCIETA' A RESPONSABILITA' LIMITATA, Padua (IT)

( * ) Notice: Subject to any disclaimer, the term of this patent is extended or adjusted under 35 U.S.C. 154(b) by 0 days.

(21) Appl. No.: 17/546,597

(22) Filed: Dec. 9, 2021

(65) Prior Publication Data

US 2022/0186406 A1 Jun. 16, 2022

(30) Foreign Application Priority Data

Dec. 10, 2020 (IT) ..... 102020000030290

(51) Int. Cl.
*D01H 7/26* (2006.01)
*D07B 3/08* (2006.01)

(52) U.S. Cl.
CPC ..... *D01H 7/26* (2013.01); *D07B 3/085* (2013.01)

(58) Field of Classification Search
CPC .. D01H 7/26; D01H 7/24; D01H 7/40; D01H 7/86; D01H 1/04; D01H 1/164;
(Continued)

(56) References Cited

U.S. PATENT DOCUMENTS 317,116 A 5/1885 Good
475,138 A * 5/1892 Munro et al. ..... D07B 3/085 57/78

(Continued)

FOREIGN PATENT DOCUMENTS

DE 1070964 B * 6/1960 ..... D07B 3/085
DE 2408521 A1 9/1975

(Continued)

OTHER PUBLICATIONS

IT Search Report dated Aug. 20, 2021 re: Application No. IT 202000030290, pp. 1-9.

*Primary Examiner* — Patrick J. Lynch
(74) *Attorney, Agent, or Firm* — CANTOR COLBURN LLP

(57) ABSTRACT

A twisting flyer for a single-twist cable stranding machine, which is adapted to rotate about a rotation axis and includes two shoulders connected by crossmembers, and an articulated structure which has in turns a first carriage provided with elements for translation on first of the crossmembers and which supports a guide pulley for a cable, and a second carriage provided with elements for translation on second of the crossmembers, which supports a counterweight for the guide pulley The twisting flyer further includes a first pair of rods which are hinged with one end thereof to the first carriage and with another end to a second pair of rods which are hinged with one end thereof to the second carriage and with another end to the first pair of rods, balancing weights at hinge regions between the first pair of rods and the second pair of rods.

9 Claims, 2 Drawing Sheets

(58) Field of Classification Search
CPC ..... D01H 1/006; D01H 1/10; D01H 9/046; D01H 13/10; B65H 54/2896; B65H 54/2827; D07B 3/085; D07B 3/10; D07B 3/103; D07B 3/106; D06B 7/10; H01B 13/0228
See application file for complete search history.

(56) References Cited

U.S. PATENT DOCUMENTS 650,708 A 5/1900 Dawes
803,666 A * 11/1905 Campbell ..... D01H 7/32 57/117
1,263,405 A * 4/1918 Grondahl ..... D07B 3/10 57/58.7
3,344,593 A * 10/1967 Aoki ..... D01H 9/10 57/267
5,509,260 A * 4/1996 Derdeyn ..... D01H 7/26 57/115
6,141,948 A * 11/2000 Brazeau ..... D07B 7/10 242/472.4

FOREIGN PATENT DOCUMENTS

FR 1395691 A 4/1965
JP 2920367 B2 * 7/1999 ..... D07B 3/10

* cited by examiner

TWISTING FLYER FOR SINGLE-TWIST CABLE STRANDING MACHINE

CROSS-REFERENCE TO RELATED APPLICATIONS

This application is related to and claims the benefit of Italian Patent Application No. 102020000030290, filed on Dec. 10, 2020, the contents of which are herein incorporated by reference in their entirety.

TECHNICAL FIELD

The present disclosure relates to a twisting flyer for single-twist cable stranding machine.

The sector to which the disclosure relates is industrial equipment and plant for the production of cables and of insulated multipolar wires, multi-filament strands of copper, steel ropes, and the like, where the requirement is to join two or more elements in order to build a stranded assembly with a determined pitch. In particular, the disclosure has applications in rotating machines, known in the sector as "cable stranding machines", which are used for the formation of a stranded product and for collecting it on a spool, starting from the individual elements that go to make it up (filaments, single cores, strands, cables, complex conductors etc.), and more specifically in single-twist stranding machines.

BACKGROUND

As is known, a single-twist cable stranding machine is substantially a rotating winder, the collection spool of which rotates inside a structure which also rotates about a same rotation axis and is known in the sector as a "rotor" or "flyer". The rotation of the flyer/spool system produces a twist of the cable for each single turn of the flyer (in fact, the term "single-twist" indicates the situation wherein one twist of the cable is obtained with one turn of the flyer).

The relative rotation speed between the flyer and the collection spool determines the stranding pitch, while the line speed is given by the product of the rotation speed of the flyer and the stranding pitch.

For the same stranding pitch, the greater the rotation speed, the higher the productivity of the machine.

The cable thus stranded is distributed using a guide pulley over the width of the collection spool using an adapted deposition system.

Two types of single-twist cable stranding machines are known: "with a cantilevered shaft", and "with tailstocks".

In the first type, the deposition of the stranded cable occurs by means of the translation of the collection spool, which is supported by a shaft of large dimensions.

In the second type, the deposition of the stranded cable occurs through the translation of a guide pulley, while the spool, which does not translate, is supported between two mutually opposite tailstocks.

In this second type of machine, "with tailstocks", the system that supports one of the two tailstocks is constituted by a shaft provided with an entrainment faceplate, conveniently motorized, which is used to make the collection spool rotate. The shaft can translate axially in order to allow the opening and closing of the tailstock clamping the spool during the step of loading and unloading thereof. On the other side, the system that supports the other tailstock does not translate and is idle, therefore it rotates by entrainment.

The flyer in this type of machine typically is made up of a structure with crossmembers which are supported by two shoulders, in the internal space of which the collection spool is accommodated coaxially.

The stratification of the cable on the collection spool is achieved by way of the translation of a guide pulley which deviates the route of the cable toward the spool. Such pulley is coupled to a ring of large dimensions which rotates concentrically around the spool and is supported by guide bushings which slide on the supporting crossmembers.

As an alternative to the translating-ring structure, some machines, which also fall into the "with tailstocks" category, but that are dedicated to different uses (with spools of large dimensions, greater weights and higher pull rates of the stranded cable) have a flyer which is produced with a steel crossmember that rotates around the collection spool. In this case the cable deposition system has a carriage holding the guide pulley which can slide on rails along the crossmember. A machine of this type, with a rotating steel crossmember, has a structure and components of large dimensions and considerable inertia, which impose a major limitation on the rotation speed and consequently on production.

In a machine with a translating and rotating ring, the differing deformation (in direction and intensity) of the ring and of the supporting crossmembers, caused by centrifugal forces, entails major friction forces on the sliding bushings. To combat these friction forces, which moreover increase proportionally with rotation speed, motors and transmission elements must necessarily be over-dimensioned with respect to a condition with low friction forces.

In addition, the deformation of the structure in any case entails an unbalancing of the entire system of rotation, which induces significant and risky vibrations on the machine in general.

Also, another drawback is encountered in the fact that during the rotation the cable to be stranded bends outward owing to the centrifugal force due to its weight, a phenomenon that increases proportionally with the rotation speed.

In general, in both versions described of a single-twist cable stranding machine "with tailstocks", owing to the drawbacks highlighted which are caused by the considerable rotating masses and by the effects of centrifugal forces, the rotation speeds are typically limited to between 350 and 500 rpm, with collection spools of 800-1000 mm in diameter.

For larger dimensions of spools, considering that the rotating structure must necessarily be larger, the speeds are further reduced.

SUMMARY

The present disclosure provides a flyer for a single-twist cable stranding machine, of the type "with tailstocks", which is capable of improving the known art in one or more of the above mentioned aspects.

Within this aim, the disclosure provides a flyer for a cable stranding machine that can operate at a higher rotation speed than conventional flyers, thus making the machine more productive.

The disclosure also provides a flyer of lower weight than conventional flyers which can be applied to the same machines.

The disclosure advantageously limits, even at high speeds, deformations of the structure and wear of the mechanical elements involved in the translation of the flyer, such as guide bushings, traction cords, guide pulleys, belts, shafts and bearings.

The disclosure is able to scale up the drive unit of the flyer.

The disclosure contains the deformation of the cable outward owing to the action of centrifugal forces.

The present disclosure overcomes the drawbacks of the background art in a manner that is alternative to any existing solutions.

The disclosure provides a twisting flyer for a cable stranding machine that is highly reliable, easy to implement and of low cost.

This aim and these and other advantages which will become better apparent hereinafter are achieved by providing a twisting flyer for a single-twist cable stranding machine, which is adapted to rotate about a rotation axis and is characterized in that it comprises two shoulders connected by crossmembers, and an articulated structure which is adapted to translate on said crossmembers and which comprises in turn:

- a first carriage which is provided with means for translation on first of said crossmembers and which supports a guide pulley for a cable,
- a second carriage provided with means for translation on second of said crossmembers, which is adapted to translate in a similar manner and in a diametrically opposite position with respect to said first carriage relative to said rotation axis, said second carriage supporting a counterweight for said guide pulley,
- a first pair of rods which are hinged with one end thereof to said first carriage and with another end thereof to
- a second pair of rods which are hinged with one end thereof to said second carriage and with another end thereof to said first pair of rods,
- balancing weights at hinge regions between said first pair of rods and said second pair of rods, which are adapted to compensate, during the rotation of said twisting flyer, a centrifugal force at said first carriage and at said second carriage.

BRIEF DESCRIPTION OF THE DRAWINGS

Further characteristics and advantages of the disclosure will become better apparent from the detailed description that follows of a preferred, but not exclusive, embodiment of the flyer for a cable stranding machine according to the disclosure, which is illustrated by way of non-limiting example in the accompanying drawings wherein.

DETAILED DESCRIPTION OF THE DRAWINGS

Figure 1:
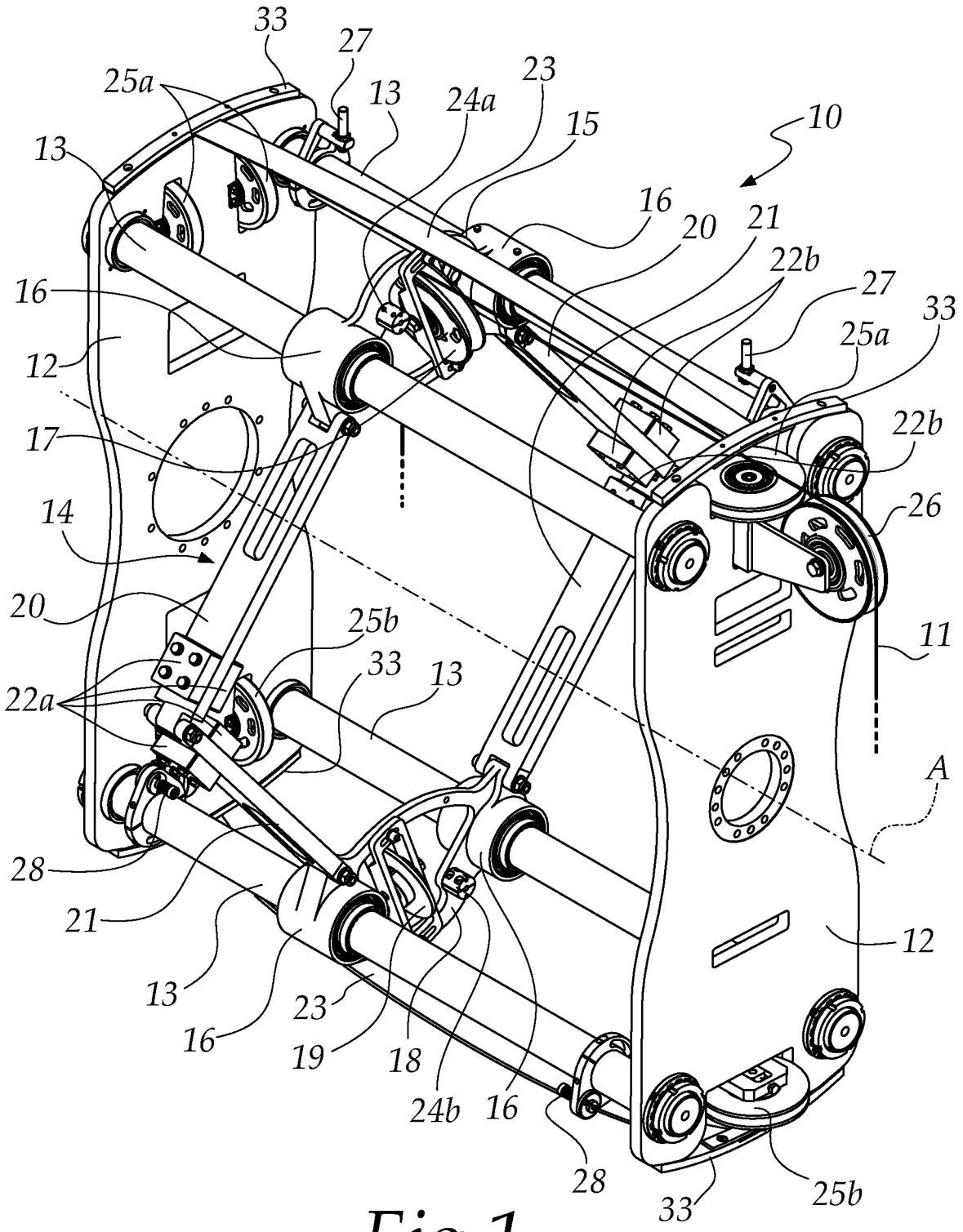
FIG. 1 is a perspective view of the twisting flyer according to the disclosure.

With reference to the figures, the twisting flyer according to the disclosure, generally designated by the reference numeral 10, being designed for a single-twist cable stranding machine, with tailstocks, is adapted to rotate about a rotation axis, here indicated with A, which matches the winding axis of a cable 11. The cable 11 is joined by the machine and deposited on a collection spool.

Figure 2:
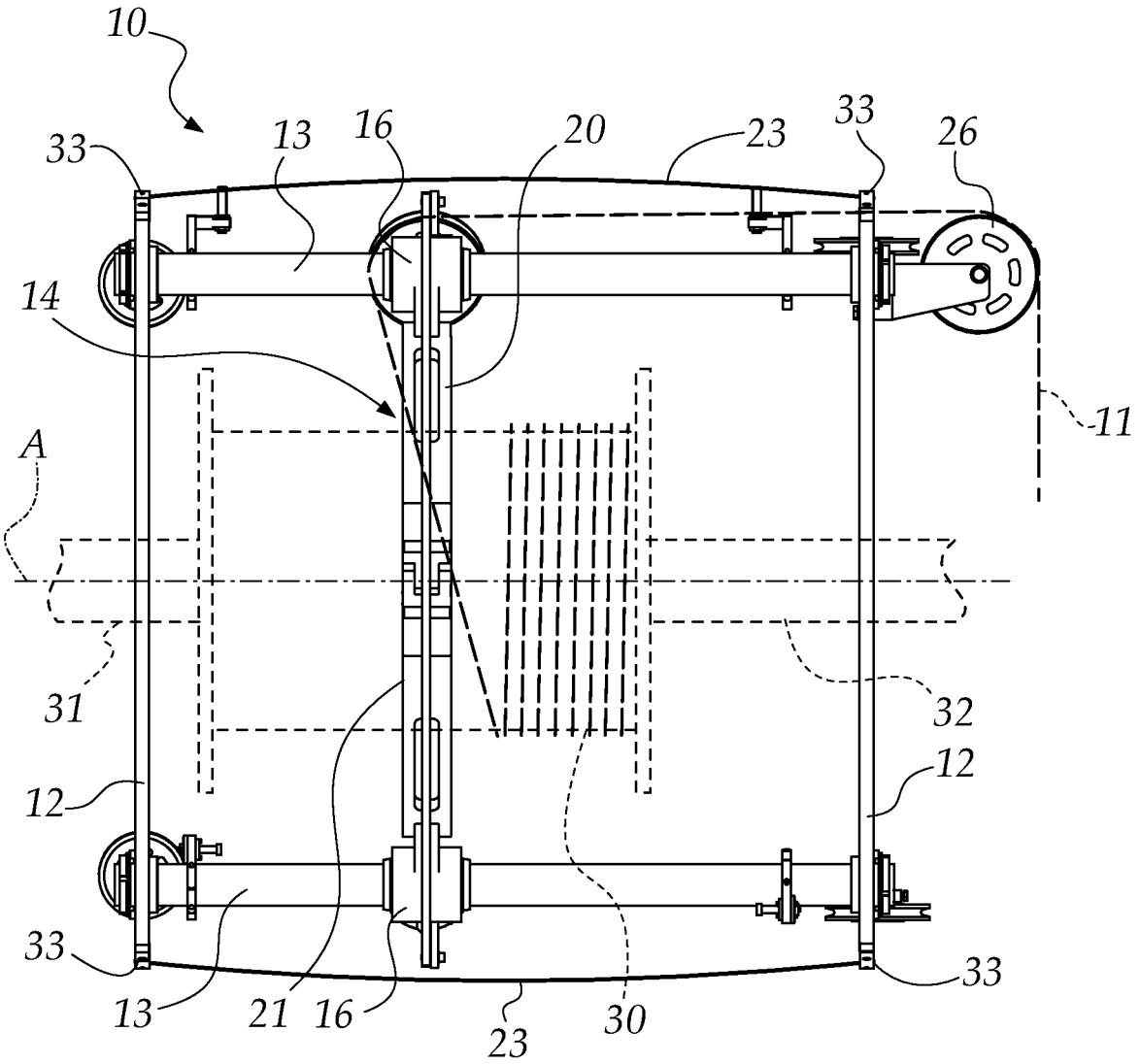
FIG. 2 is a side view of the twisting flyer according to the disclosure.

Inside the twisting flyer 10, on the same rotation axis A, a takeup spool 30 of the cable 11, shown in dotted lines in FIG. 2, is adapted to rotate. The spool 30 can be installed inside the flyer 10 in a per se known manner in the sector, with tailstocks supporting it. At one end the tailstock is provided with a shaft 31 which has an entrainment faceplate, conveniently motorized, to make it rotate, while the other tailstock, at the other end, is provided with a shaft 32 which is mounted idle. Another drive unit, also of conventional type and not shown for the sake of simplicity, is adapted to make the flyer rotate concentrically around the spool 30, on the same rotation axis A, in synchronization with the spool.

The twisting flyer 10 comprises two shoulders 12 which are connected by crossmembers 13, four in the example shown.

The twisting flyer 10 advantageously comprises an articulated structure 14, substantially quadrilateral, which is adapted to translate on the four crossmembers 13 and which comprises in turn:

- a first carriage 15 which is provided with means for translation 16 on first crossmembers 13, the upper ones in the illustration, and which supports a guide pulley 17 for the cable 11 which is coupled to it,
- a second carriage 18 provided with means for translation 16 on second crossmembers 13, which is adapted to translate in a similar manner and in a diametrically opposite position with respect to the first carriage 15 relative to the rotation axis A, the second carriage 18 supporting a counterweight 19 for the guide pulley 17 of the cable 11.

The articulated structure 14 also comprises:

- a first pair of rods 20 which are hinged with one end thereof to the first carriage 15 and with the other end to
- a second pair of rods 21 which are hinged with one end thereof to the second carriage 18 and with the other end to the first pair of rods 20,
- balancing weights 22*a*, 22*b* at the hinge regions between the first pair of rods 20 and the second pair of rods 21, which are adapted to compensate, during the rotation of the twisting flyer 10, the centrifugal force at the first carriage 15 and at the second carriage 18, in the manner that will become clearer in the description of the operation of the flyer 10 according to the disclosure. The balancing weights 22*a* between two rods, one of the first pair of rods 20 and the other of the second pair of rods 21, are positioned mirror-symmetrically with the balancing weights 22*b* between the other two rods 20 and 21, and are equivalent to them. They are defined at the design stage, as a function of the weight of the carriages (the second carriage 18, with the counterweight 19, has the same weight as the first carriage 15, with the guide pulley 17) and of the distance of the carriages and of the hinges from the centers of rotation, substantially starting from trigonometric calculations.

In an embodiment not shown, the rods 20 and 21 can have a curved shape, defining overall a substantially circumferential structure.

The articulated structure 14, with the carriages and the guide pulley 17, constitute a wire-guide system that is adapted to translate rigidly along the crossmembers 13, pulled by a motor, in a conventional manner, using a steel cable coupled to the respective carriages, the first carriage 15 and the second carriage 18, with the clamps 24*a* and 24*b*, which are installed on the carriages. This cable is not shown, in order to simplify the illustration. It passes through a system of idle pulleys 25*a* and 25*b*, which are coupled to the shoulders 12 of the flyer 10.

There is also a system of pulleys, including the pulley 26 installed on one shoulder 12 in a cantilever fashion directed outward. The cable 11 to be stranded undergoes one twist for each turn of the flyer 10 and is conducted on the flyer through the pulley 26 and is deviated by the guide pulley 17 toward the collection spool 30.

In the example shown, the means for translation 16 for the first carriage 15 and for the second carriage 18 are constituted by sliding bushings with which they are adapted to translate on the crossmembers 13, the latter having a circular cross-section. In particular, the crossmembers 13 are tubular elements coupled with their ends to the shoulders 12 of the structure.

The sliding bushings are conventional per se and are made preferably of plastic material and in two symmetrical parts, in order to follow the deformation of the crossmembers 13 during the rotation of the flyer 10.

The balancing weights 22*a* and 22*b* comprise at least one block which is fixed to each one of the rods, of the first pair 20 and of the second pair 21.

The twisting flyer 10, according to the disclosure, also comprises stroke limit sensors 27 and 28 for the first 15 and second 18 carriages, which are installed on the crossmembers 13, proximate to the ends thereof, in particular on two of the crossmembers. Sensors 27 are mounted on one of the crossmembers 13 and are adapted to detect the presence of the first carriage 15, while sensors 28 are mounted on the other crossmember 18 which have a spring on which contact can occur with the carriage 18 or with a bushing. The contact or the presence detected by the sensors 27, 28 activates a control system which stops the cable stranding machine, thus preventing damage owing to a possible overtravel of the carriages.

Advantageously, the twisting flyer 10 according to the disclosure comprises a pair of arc-like elements 23, each one fixed via brackets 33 with the ends to the two shoulders 12 at at least one pair between the first crossmembers and the second crossmembers 13 and at a distance from the rotation axis A that is greater than the distance of the crossmembers 13 from that axis A. The function of such arc-like elements 23 is to contain the cable 11. Being adapted to rotate with the rest of the structure of the flyer about the rotation axis A, their purpose is to contain the camber of the cable caused by the centrifugal force acting on it owing to the high rotation speed and deriving from the weight of the cable itself. The heavier the cable and the less it is subjected to traction during its unreeling (an increase in the traction can sacrifice its quality), the greater the deformation of the cable.

Conveniently the transverse cross-section of each arc-like element 23 has a concave surface directed toward the rotation axis. Such arc-like element is preferably made of composite material and is covered with plastic material by virtue of which the concave surface has an anti-friction finish which, as a consequence, protects the object from the wear owing to slipping of the cable.

Operation of the twisting flyer, according to the disclosure, is the following.

When the stranding machine in which the twisting flyer 10 is installed is put into operation, the flyer is made to rotate. During the rotation the articulated structure 14 performs a translational motion with the first 15 and second 18 carriages, along the crossmembers 13. The speed of displacement of the system determines the pitch of deposition of the cable 11 on the spool 30, which is installed concentrically in the space defined by the articulated structure 14.

The twisting flyer 10 is made to rotate with a different angular speed from that of the spool 30 and is adjustable as a function of the desired stranding pitch.

During the rotation of the twisting flyer 10 the centrifugal forces owing to the weight of the carriages 15 and 18, with the pulley 17 and the counterweight 19, are balanced by the centrifugal forces generated by the balancing weights 22*a* and 22*b* mounted on the hinged rods. Therefore, during the rotation of the articulated structure 14, when the carriages translate on the crossmembers, no friction forces are generated.

Owing to the balancing of the forces, the center of gravity of the system is on the rotation axis A, thus preventing vibrations of the structure. The articulated structure 14, which is rendered elastic by the hinges, follows the deformation of the supporting crossmembers caused by the centrifugal forces, thus avoiding interference (and therefore great friction forces) on the sliding bushings, contrary to what happens in conventional rigid systems with an annular structure.

The structure of the twisting flyer according to the disclosure has lower volume, mass and inertia than conventional structures, with consequent possible resizing of the drive unit used for the rotation (less air friction, less rolling resistance in the bearings).

The balancing at all speeds of the forces acting on the guide bushings for the translation results in a reduction of the friction forces thereon, and therefore also in a reduction of wear of the sliding systems and of the elements in motion in the machine, such as cords, belts, pulleys, shafts, and bearings. A greater slideability of the wire guide system results in less friction forces to combat and in a scaling up of the drive unit designed to the translation.

With the balancing of the centrifugal forces, which occurs at any rotation speed, the drive unit can be increased, with consequent increase of the line speed and therefore of the productivity of the machine.

It should also be noted that, by virtue of the arc-like element, it is possible to contain the deformation of the cable without limiting the number of revolutions per minute of rotation, as by contrast happens in conventional flyers.

The twisting flyer according to the disclosure can reach speeds of 1000 rpm with spools of 630 mm diameter, while containing the deformation of the cable and thus preventing it from becoming entangled in other parts of the machine.

In practice it has been found that the disclosure fully achieves the intended aim and objects by providing a twisting flyer for a single-twist cable stranding machine, which makes the machine more productive and more efficient than conventional solutions, while at the same time limiting wear on the sliding means and on the moving elements.

The disclosure thus conceived is susceptible of numerous modifications and variations, all of which are within the scope of the appended claims. Moreover, all the details may be substituted by other, technically equivalent elements.

In practice the materials employed, provided they are compatible with the specific use, and the contingent dimensions and shapes, may be any according to requirements and to the state of the art.

What is claimed is:

1. A twisting flyer for a single-twist cable stranding machine, which is adapted to rotate about a rotation axis, the twisting flyer comprises:

two shoulders connected by crossmembers, and an articulated structure which is adapted to translate on said crossmembers, a first carriage which is provided with means for translation on a first of said crossmembers and which supports a guide pulley for a cable, a second carriage provided with means for translation on a second of said crossmembers, which is adapted to translate in a similar manner and in a diametrically opposite position with respect to said first carriage relative to said rotation axis, said second carriage supporting a counterweight for said guide pulley, a first pair of rods which are hinged with one end thereof to said first carriage and with another end thereof to a second pair of rods which are hinged with one end thereof to said second carriage and with another end thereof to said first pair of rods, balancing weights at hinge regions between said first pair of rods and said second pair of rods, which are adapted to compensate, during the rotation of said twisting flyer, a centrifugal force at said first carriage and at said second carriage.

2. The twisting flyer according to claim 1, wherein said means for translation for said first carriage and for said second carriage comprise sliding bushings with which said means for translation are adapted to translate on said crossmembers, said crossmembers having a circular cross-section.

3. The twisting flyer according to claim 2, wherein said sliding bushings are made of plastic material and are formed by two symmetrical parts.

4. The twisting flyer according to claim 1, wherein said balancing weights comprise at least one block which is fixed to each one of said rods of said first pair and of said second pair.

5. The twisting flyer according to claim 1, further comprising stroke limit sensors for said first and said second carriages, which are installed on said crossmembers proximate to the ends of said crossmembers.

6. The twisting flyer according to claim 1, further comprising at least one arc-like element which is fixed with ends thereof to said two shoulders, said at least one arc-like element being arranged intermediate between said crossmembers and at a distance from said rotation axis that is greater than a distance of said crossmembers from said axis.

7. The twisting flyer according to claim 6, wherein a transverse cross-section of said arc-like element has a concave surface directed toward the rotation axis.

8. The twisting flyer according to claim 7, wherein said concave surface of said arc-like element has an anti-friction finish.

9. The twisting flyer according to claim 1, wherein said rods of said first and second pair of rods have an arc-like shape.

* * * * *